US008311466B2

(12) United States Patent
Kamijo et al.

(10) Patent No.: US 8,311,466 B2
(45) Date of Patent: Nov. 13, 2012

(54) IMAGE FORMING APPARATUS AND IMAGE FORMING METHOD

(75) Inventors: Koichi Kamijo, Matsumoto (JP); Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 12/722,187

(22) Filed: Mar. 11, 2010

(65) Prior Publication Data

US 2010/0232845 A1 Sep. 16, 2010

(30) Foreign Application Priority Data

Mar. 12, 2009 (JP) ..... 2009-059302

(51) Int. Cl.
*G03G 15/20* (2006.01)

(52) U.S. Cl. ..... 399/313

(58) Field of Classification Search ..... 399/68, 399/116, 121, 297, 313
See application file for complete search history.

(56) References Cited

U.S. PATENT DOCUMENTS

| | | | | |
|---|---|---|---|---|
| 6,151,477 | A * | 11/2000 | Takeuchi et al. | 399/318 |
| 6,314,881 | B1 | 11/2001 | Goetting | |
| 6,389,242 | B1 | 5/2002 | Watanabe | |
| 2004/0126138 | A1* | 7/2004 | Furuki et al. | 399/149 |
| 2007/0196126 | A1* | 8/2007 | Tanaka et al. | 399/121 |

FOREIGN PATENT DOCUMENTS

| | | |
|---|---|---|
| JP | 2000-033686 | 2/2000 |
| JP | 2002-156839 | 5/2002 |

OTHER PUBLICATIONS

Translation of Naoyuki (JP410083124A, pub date: Mar. 31, 1998).*

* cited by examiner

*Primary Examiner* — Walter L Lindsay, Jr.
*Assistant Examiner* — Frederick Wenderoth
(74) *Attorney, Agent, or Firm* — Workman Nydegger

(57) ABSTRACT

An image forming apparatus including an image carrier that carries an image, a transfer roller that abuts on the image carrier and has a grooved portion in an axial direction, an abutting member that is arranged in an axial end side of the transfer roller and includes a first circumference portion having a first distance from a rotation center of the transfer roller and a second circumference portion having a second distance which is shorter than the first distance, and a support member that abuts the abutting member.

7 Claims, 13 Drawing Sheets

IMAGE FORMING APPARATUS AND IMAGE FORMING METHOD

The entire disclosure of Japanese Patent Application No. 2009-059302, filed Mar. 12, 2009, is expressly incorporated herein by reference.

BACKGROUND OF THE INVENTION

1. Technical Field

The present invention relates to an image forming apparatus and image forming method. More specifically, the present invention relates an image forming apparatus by which an image is formed by developing a latent image formed on a photosensitive body using a liquid developer containing a toner and a carrier, transferring the developer onto a medium such as a recording sheet, and fusing and fixing a toner image on the transferred medium.

2. Related Art

Various wet type image forming apparatuses are currently known in the art in which a latent image is developed using a high-viscosity liquid developer obtained by dispersing a toner containing solid elements in a liquid solvent. Using this process, an electrostatic latent image is made visible. The developer used in such a wet type image forming apparatus is obtained by suspending solid contents or toner particles in a high-viscosity organic solvent or carrier liquid which is made of silicon oil, mineral oil, cooking oil, or the like, which has an electric insulation property. The toner particles have a diameter of about 1 μm which is significantly small. Since the wet type image forming apparatus uses such small toner particles, it can provide a higher quality image in comparison to a dry type image forming apparatus which uses powder toner particles having a diameter of about 7 μm.

One example of an image forming apparatus currently known in the art is Japanese Patent Document JP-A-2002-156839, which includes an image forming device which forms an electrostatic latent image on an image carrier, a developing device which develops the electrostatic latent image on the image carrier using a liquid developer obtained by dispersing developer particles in a solvent to make the image visible, an intermediate transfer medium which abuts on the image carrier to transfer the visible image on the image carrier thereto, a transfer device which has a backup member that abuts the intermediate transfer medium and transfers the visible image on the intermediate transfer medium to the transfer target body, a determination device which determines the type of transfer target body, and a control device which variably controls a pressure force applied to the transfer target body by the backup member depending on the type of the transfer target body.

One problem with the backup member of the configuration described in '839, however, is that when a grooved portion is provided in the backup member of the image forming apparatus disclosed in JP-A-2002-156839 such that a transfer material gripping mechanism for gripping the transfer material may be disposed in the grooved portion, the pressing member does not provide a sufficient force when the grooved portion and the intermediate transfer medium face each other.

In print industries, a so-called bearer which is an abutting member having a concentric circle has been used to control an abutting position between rollers (e.g., see JP-A-2000-33686). When the transfer is performed in this way, the distance between rollers is controlled by positions of each bearer. One problem with this configuration, however, is that there is a problem when a transfer material such as paper has different thicknesses, and the transfer pressure is accordingly changed, and thereby, the transfer may become unstable.

BRIEF SUMMARY OF THE INVENTION

A first aspect of the invention is an image forming apparatus including an image carrier that carries an image, a transfer roller that abuts on the image carrier and has a grooved portion in an axial direction, an abutting member that is arranged in an axial end side of the transfer roller and includes a first circumference portion having a first distance from the rotation center of the transfer roller and a second circumference portion having a second distance which is shorter than the first distance, and a support member that abuts the abutting member.

A second aspect of the invention is an image forming apparatus including an image carrier that moves into a first direction and carries an image, a transfer roller that abuts on the image carrier and has a grooved portion in an axial direction, an abutting member that is arranged in a second direction perpendicular to the first direction of the image carrier and has a first circumference portion arranged at a first distance from a rotation center of the transfer roller when the first circumference portion faces the transfer roller and a second circumference portion disposed a second distance different from the first distance, and a support member that abuts the abutting member.

A third aspect of the invention is an image forming method including storing an image on an image carrier, transferring the image to a transfer material by passing the transfer material through a transfer nipping area formed by making a transfer roller having a grooved portion in an axial direction abut on the image carrier, making a first circumference portion of an abutting member arranged in an axial end side of the transfer roller abut on the support member which abuts on the abutting member when the grooved portion of the transfer roller passes through the transfer nipping area after the transfer material passes through the transfer nipping area, the first circumference portion having a first distance from a rotation center of the transfer roller, and controlling positions of the image carrier and the transfer roller.

According to the image forming apparatus and the image forming method of the invention, while the transfer roller is pressed to the belt winding roller side, the shaft of the transfer roller has the abutting member, and the shaft of the belt winding roller has the supporting member. As a result, the transfer roller can be used to apply a predetermined pressure to the transfer nip when the grooved portion does not make contact with the transfer belt. Simultaneously, the positional relationship between the transfer roller and the belt winding roller can be maintained when the grooved portion faces the transfer belt.

According to the image forming apparatus and the image forming method of the invention, even when the transfer roller having the grooved portion is used, transition can be seamlessly made without generating vibration between a constant load state in which a constant pressure is applied to the transfer nip and a fixed position state in which the transfer roller and the belt winding roller are maintained in a fixed positional relationship. As a result, it is possible to suppress influences on the image forming process and prevent image quality degradation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
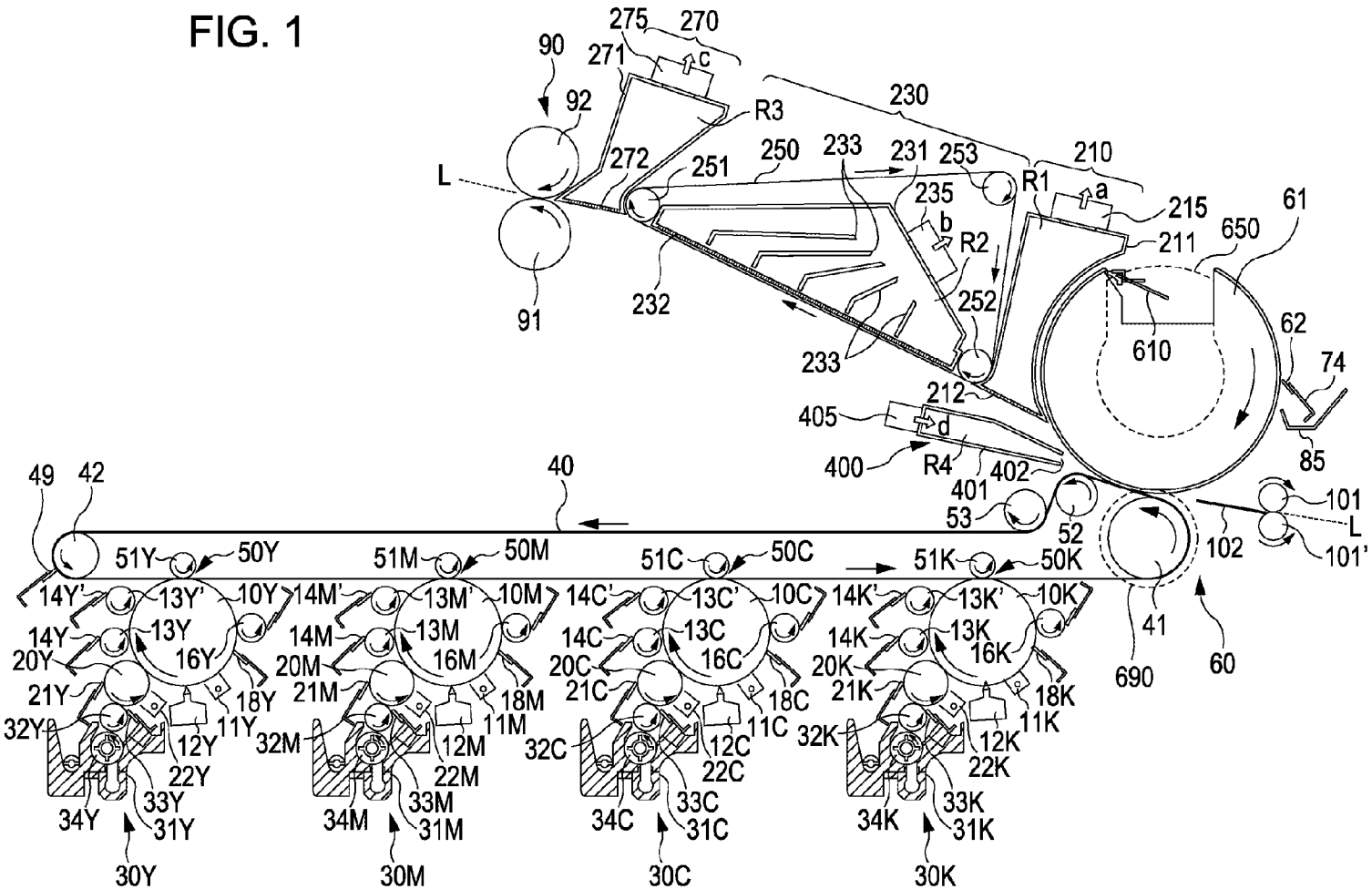
FIG. 1 illustrates main components of an image forming apparatus according to an embodiment of the invention.

Hereinafter, embodiments of the invention will be described with reference to the accompanying drawings. FIG. 1 illustrates main components of the image forming apparatus according to an embodiment of the invention. In image forming sections corresponding to each color disposed in the center of the image forming apparatus, developing devices 30Y, 30M, 30C, and 30K are disposed in a lower part of the image forming apparatus, whereas a transfer belt 40, a secondary transfer section 60, a fixing unit 90, or the like are disposed in an upper part of the image forming apparatus. Particularly, the entire installation area of the image forming apparatus can be suppressed by laying out the fixing unit 90 over the transfer belt 40. According to the present embodiment, it is possible implement such a layout because the transfer material, such as paper, to which a secondary transfer has been executed by the secondary transfer unit 60, is transported to the fixing unit 90 while being fed by the transfer material transport device 230, the suction devices 210 and 270, or the like.

The developing devices 30Y, 30M, 30C, and 30K include photosensitive bodies 10Y, 10M, 10C, and 10K, corona chargers 11Y, 11M, 11C, and 11K, and exposure units 12Y, 12M, 12C, and 12K, respectively, such as an LED array, in order to form an image using a toner. The photosensitive bodies 10Y, 10M, 10C, and 10K are uniformly charged by the corona chargers 11Y, 11M, 11C, and 11K, and exposure is performed by the exposure units 12Y, 12M, 12C, and 12K based on an input image signal, so that the electrostatic latent image is formed on the charged photosensitive bodies 10Y, 10M, 10C, and 10K.

The developing devices 30Y, 30M, 30C, and 30K generally include developing rollers 20Y, 20M, 20C, and 20K, developer reservoirs 31Y, 31M, 31C, and 31K for storing yellow Y, magenta M, cyan C, and black K liquid developers. Anilox rollers 32Y, 32M, 32C, and 32K function as application rollers for applying the liquid developers of each color from the developer reservoirs 31Y, 31M, 31C, and 31K to the developing rollers 20Y, 20M, 20C, and 20K, or the like. The developing devices 30Y, 30M, 30C, and 30K develop the electrostatic latent image formed on the photosensitive bodies 10Y, 10M, 10C, and 10K using the liquid developers of each color.

The transfer belt 40 is an endless belt which is looped around a driving roller 41 and winding rollers 42, 52, and 53 and is rotatably driven by the driving roller 41 while abutting on the photosensitive bodies 10Y, 10M, 10C, and 10K at the primary transfer units 50Y, 50M, 50C, and 50K. In the primary transfer units 50Y, 50M, 50C, and 50K, the primary transfer rollers 51Y, 51M, 51C, and 51K are disposed opposite to the photosensitive bodies 10Y, 10M, 10C, and 10K, respectively, with the transfer belt 40 disposed there between. The primary transfer units 50Y, 50M, 50C, and 50K sequentially overlap and transfer the toner images of each color developed on the photosensitive bodies 10Y, 10M, 10C, and 10K to the transfer belt 40 by setting the positions abutting on the photosensitive bodies 10Y, 10M, 10C, and 10K as transfer positions to form a full-color toner image.

In the secondary transfer unit 60, the secondary transfer roller 61 is disposed to face the belt driving roller 41 with the transfer belt 40 disposed there between. A cleaning device including a secondary transfer roller cleaning blade 62 is also disposed in the secondary transfer unit 60. At the transfer position where the secondary transfer roller 61 is disposed, a monochrome or full-color toner image formed on the transfer belt 40 is transferred to the transfer material such paper, film, or fabric transported along the transfer material transport path L.

In the downstream of the transfer material transport path L, an air blower 400 for discharging air to a gap between the transfer belt 40 and the secondary transfer roller 61, a first suction device 210, a transfer material transport device 230, and a second suction device 270 are sequentially arranged to transport the transfer material to the fixing unit 90. In the fixing unit 90, a monochrome or full-color toner image transferred to the transfer material such as paper is fused and fixed onto the transfer material.

The transfer belt 40 is looped around the winding roller 42 together with the belt driving roller 41 or the like. At the position of the transfer belt 40 at the winding roller 42, a cleaning device having a transfer belt cleaning blade 49 is disposed and abuts the transfer belt 40 in order to clean remaining toner or carrier on the transfer belt 40. A force for driving the transfer belt 40 may be applied from the winding roller 42 to allow the belt driving roller 41 to be used as a simple belt winding roller.

The transfer material is supplied to the image forming device using a feeding device (not shown). The transfer material set in such a feeding device is output one by one to the transfer material transport path L at a predetermined timing. In the transfer material transport path L, the transfer material is transported to the secondary transfer position using the gate rollers 101 and 101' and the transfer material guide 102, and the monochrome or full-color toner-developed image formed on the transfer belt 40 is transferred to the transfer material. As described above, the transfer material to which the secondary transfer has been performed is further transported to the fixing unit 90 using a transfer material transport unit mainly comprised of the transport material transport device 230. The fixing unit 90 includes a heating roller 91 and a press roller 92 pressed to the heating roller 91 with a predetermined pressure. The fixing unit 90 fuses and fixes the monochrome or full-color toner image transferred to the transfer material on the transfer material by passing the transfer material through a nipping area by insertion.

While the developing device will now be described, since the image forming sections and the developing devices are similarly configured for each color, hereinafter, a description will focus only on the image forming section and the developing device of the yellow color Y.

In the image forming section, a photosensitive body cleaning roller 16Y, a photosensitive body cleaning blade 18Y, a corona charger 11Y, an exposure unit 12Y, a developing roller 20Y of the developing device 30Y, a first photosensitive body squeeze roller 13Y, and a second photosensitive body squeeze roller 13Y' are disposed along a rotation direction of the outer circumference of the photosensitive body 10Y.

The photosensitive body cleaning roller 16Y is rotated in a counterclockwise direction while abutting on the photosensitive body 10Y to clean remaining transfer liquid developer or transfer liquid developer not used in the transfer on the photosensitive body 10Y. A bias voltage for attracting the toner particles in the liquid developer is applied to the photosensitive body cleaning roller 16Y, and salvaged material of the photosensitive body cleaning roller 16Y is recovered, comprising a liquid developer which is rich in solid contents and contains a large amount of toner particles.

In the downstream of the photosensitive body cleaning roller 16Y, the photosensitive body cleaning blade 18Y abutting the photosensitive body 10Y cleans the liquid developer which is rich in carrier contents on the photosensitive body 10Y.

In the developing device 30Y, a cleaning blade 21Y, an anilox roller 32Y, and a compaction corona generator 22Y are disposed in the outer circumference of the developing roller 20Y. A control blade 33Y adjusts the amount of the liquid developer supplied to the developing roller 20Y and abuts the anilox roller 32Y. The liquid developer reservoir 31Y stores an auger 34Y. In a position facing the photosensitive body 10Y, the primary transfer roller 51Y of the primary transfer unit is disposed so as to pinch the transfer belt 40.

The photosensitive body 10Y is a photosensitive drum comprising a cylindrical member in which a photosensitive layer such as an amorphous silicon photosensitive body is formed on the outer circumference and is rotated in a clockwise direction.

The corona charger 11Y is located upstream in the rotation direction of the photosensitive body 10Y with respect to the nip portion between the photosensitive body 10Y and the developing roller 20Y. The corona charger 11Y receives a voltage from a power supply (not shown) so as to charge the photosensitive body 10Y. The exposure unit 12Y is located downstream of the photosensitive body 10. The exposure unit 12Y irradiates light onto the photosensitive body 10Y charged by the corona charger 11Y to form a latent image on the photosensitive body 10Y. Herein, components such as rollers located in the former stage throughout the image forming process are described as being located in the upstream with respect to components such as rollers located in the latter stage.

The developing device 30Y includes a compaction corona generator 22Y which induces compaction and a developer reservoir 31Y which stores a liquid developer obtained by dispersing a toner within a carrier at a weight percentage of about 20%.

Further, the developing device 30Y includes a developing roller 20Y which supports the aforementioned liquid developer, an anilox roller 32Y which functions as an application roller for applying the liquid developer to the developing roller 20Y, a control blade 33Y which controls the amount of the liquid developer applied to the developing roller 20Y, an auger 34Y which supplies the liquid developer to the anilox roller 32Y while stirring and transporting the liquid developer, a compaction corona generator 22Y which causes the liquid developer held in the developing roller 20Y to be in a compaction state, and a developing roller cleaning blade 21Y which cleans the developing roller 20Y.

The liquid developer stored in the developer reservoir 31Y is a nonvolatile liquid developer which is nonvolatile at room temperature having a high concentration and viscosity instead of a generally-used volatile liquid developer which is volatile at room temperature and has a low concentration (e.g., 1 to 3 wt %) and a low viscosity using Isopar (a trademark of Exxon Mobil Corp.) as a carrier. In other words, the liquid developer according to the invention is a high viscosity liquid developer (of which the viscous elasticity is about 30 to 300 mPa·s when the shear velocity is 1000(1/s) at a temperature of 25° C. using HAAKE RheoStress RS600) which has a toner solid content concentration of about 15 to 25% and is obtained by adding solid particles having an average particle diameter of 1 μm obtained by dispersing a colorant such as a pigment in thermoplastic resin to a liquid solvent such as an organic solvent, silicon oil, mineral oil, or cooking oil with a dispersant.

The anilox roller 32Y functions as an application roller which supplies and applies the liquid developer to the developing roller 20Y. The anilox roller 32Y is a cylindrical member having a corrugated surface formed by minutely and uniformly engraving spiral trenches on the surface to make it easier to hold the developer on the surface. By using the anilox roller 32Y, the liquid developer is supplied from the developer reservoir 31Y to the developing roller 20Y. As shown in FIG. 1, during the operation of the device, the auger 34Y is rotated in a counterclockwise direction to supply the liquid developer to the anilox roller 32Y, and the anilox roller 32Y is rotated in a counterclockwise direction to apply the liquid developer to the developing roller 20Y.

The control blade 33Y is an elastic blade obtained by coating an elastic material on the surface and includes a rubber portion made of, for example, urethane rubber, and abuts the surface of the anilox roller 32Y or the like. The control blade 33Y controls the amount and the film thickness of the liquid developer held and transported by the anilox roller 32Y in order to adjust the amount of the liquid developer supplied to the developing roller 20Y.

The developing roller cleaning blade 21Y is made of, for example, rubber which abuts on the surface of the developing roller 20Y and is located downstream from the developing roller 20Y with respect to the developing nip portion where the developing roller 20Y abuts on the photosensitive body 10Y so as to scrape off the liquid developer which has remained in the developing roller 20Y.

The compaction corona generator 22Y is an electric field application device for increasing the charging bias on the surface of the developing roller 20Y. By using the compaction corona generator 22Y, an electric field is applied from the compaction corona generator 22Y side to the developing roller 20Y at the compaction portion. Further, as the electric field application device for compaction, a compaction roller may be used instead of the corona discharge of the corona discharger shown in FIG. 1.

The developer that has been held and compacted in the developing roller 20Y is developed according to the latent image on the photosensitive body 10Y by applying a predetermined electric field to the developing nip portion where the developing roller 20Y abuts on the photosensitive body 10Y.

The developer remaining after the development is scraped off by the developing roller cleaning blade 21Y and is dropped in a recovery section within the developer reservoir 31Y for recycling. Here, the carrier and the toner recycled in this manner are not in a mixed color state.

The photosensitive body squeeze device located upstream of the primary transfer is located downstream to the developing roller 20Y to face the photosensitive body 10Y in order to recover surplus carrier in the toner image developed by the photosensitive body 10Y. This photosensitive body squeeze device includes a first photosensitive body squeeze roller 13Y and a second photosensitive body squeeze roller 13Y' comprising elastic roller members rotated by coming into contact with the photosensitive body 10Y and have the function of recovering surplus carrier and excess fog toner from the toner image developed on the photosensitive body 10Y and increasing the toner particle ratio within the developed (toner) image. Further, a predetermined bias voltage is applied to the photosensitive body squeeze rollers 13Y and 13Y'.

The surface of the photosensitive body 10Y enters the primary transfer unit 50Y after passing through the squeeze device including the first and second photosensitive body squeeze rollers 13Y and 13Y'.

At the primary transfer unit 50Y, the developer image developed on the photosensitive body 10Y is transferred to the transfer belt 40 using the primary transfer roller 51Y. At the primary transfer unit 50Y, the toner image on the photosensitive body 10 is transferred to the transfer belt 40 by using a transfer bias applied to the primary transfer backup roller 51. Here, the photosensitive body 10Y and the transfer belt 40 are moved at a constant velocity to reduce the driving loads for rotation and movement and to prevent disturbance on the developing toner of the photosensitive body 10Y.

By implementing a similar process to the aforementioned developing process of the developing device 30Y, the magenta M, cyan C, and black K toner images are also formed on the photosensitive bodies 10M, 10C, and 10K in the developing devices 30M, 30C, and 30K, respectively. The transfer belt 40 passes through the nipping area of the primary transfer unit 50 of each of yellow Y, magenta M, cyan C, and black K colors so that developers (i.e., developing images) on the photosensitive bodies of each color are transferred and overlapped. Then, the transfer belt 40 enters the nip portion of the secondary transfer unit 60.

While the transfer belt 40 passing through the secondary transfer unit 60 revolves back to the primary transfer unit 50 in order to receive a transfer image, the transfer belt 40 is cleaned by the transfer belt cleaning blade 49 or the like in the upstream with respect to a location where the primary transfer unit 50 is operated.

The transfer belt 40 has a three-layer structure in which an elastic intermediate layer made of polyurethane is formed on a polyimide base layer, and a PFA surface layer is formed thereon. Such a transfer belt 40 is looped around a belt driving roller 41 and winding rollers 42, 52, and 53 in the polyimide base layer side and used in such a way that the toner image is transferred in the PFA surface layer side. Since the transfer belt 40 formed in such a way with a tension provides excellent tracking and responding capabilities to the surface of the transfer material, it is effectively used to transmit and transfer the toner particles, particularly those having a smaller diameter, to the grooved portion of the transfer material during the secondary transfer.

Figure 2:
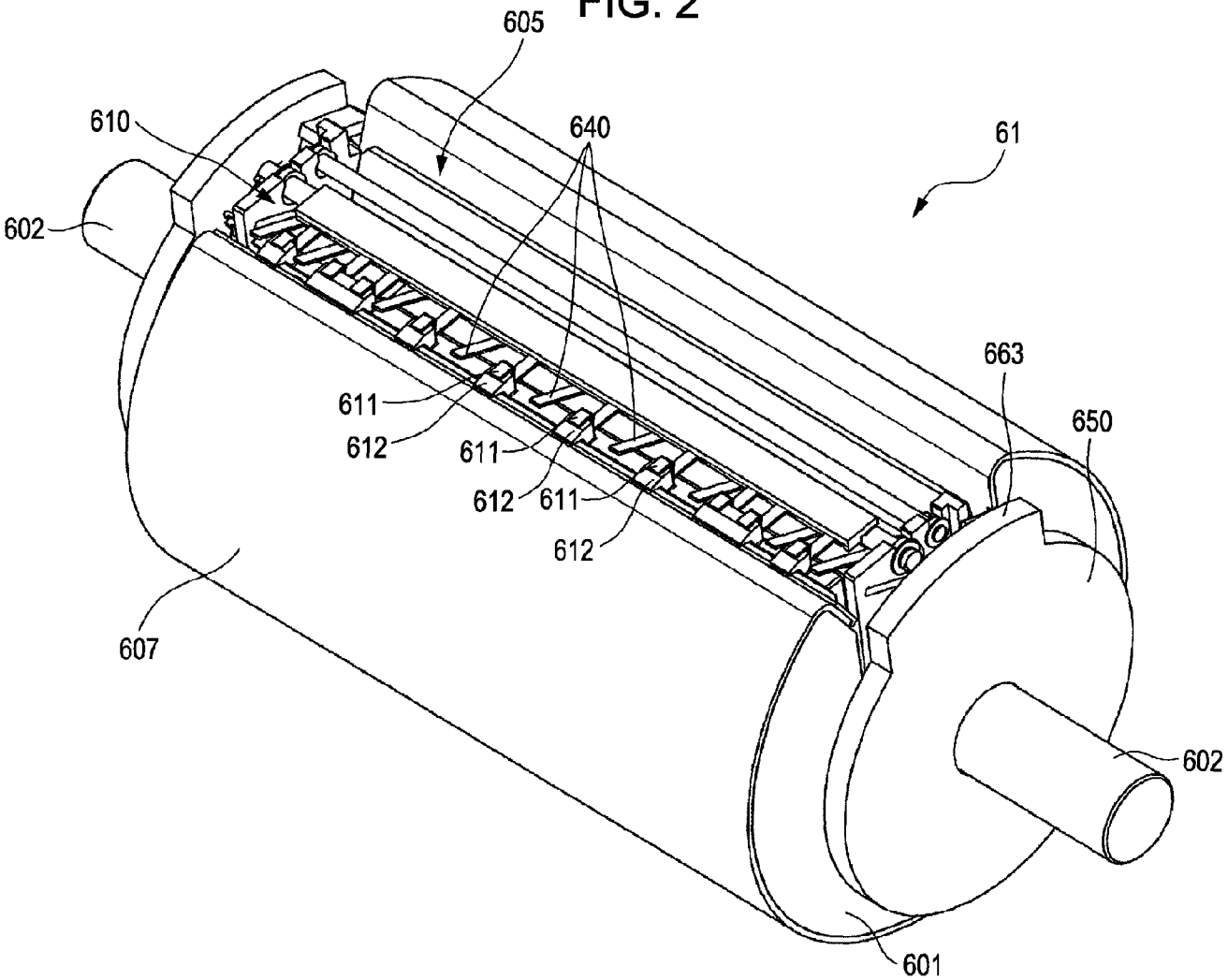
FIG. 2 is a perspective view illustrating a secondary transfer roller used in the image forming apparatus according to an embodiment of the invention.

Next, the secondary transfer roller 61 used in the image forming apparatus according to the present embodiment will be described in more detail. FIG. 2 is a perspective view illustrating the secondary transfer roller used in the image forming apparatus according to an embodiment of the invention. Referring to FIG. 2, in secondary transfer roller 61, a roller barrel 601, a roller shaft 602, a grooved portion 605, an elastic member 607, a transfer material gripping mechanism 610, a transfer material gripping portion 611, a transfer material gripping portion receptacle 612, a transfer material exfoliation member 640, and an abutting member 650 are provided.

Since the roller shaft 602 is provided in both ends of the roller barrel 601 of the secondary transfer roller 61, the secondary transfer roller 61 is installed in the main body of the image forming apparatus so as to be able to freely pivot with respect to the roller shaft 602. The roller barrel 601 has a grooved portion 605 spanning in an axial direction. The transfer material gripping mechanism 610 is provided in the grooved portion 605. The elastic member 607 is provided in a remaining part of the roller barrel 601 other than the grooved portion 605. The transfer material gripping mechanism 610 is provided for gripping or releasing the transfer material. The elastic member 607 is made of a semi-conductive elastic rubber layer having an electric resistance element. The toner image is transferred from the transfer belt 40 to the transfer material when the elastic member 607 passes through the secondary transfer nipping area in the secondary transfer unit while the transfer material is wound around the elastic member 607.

The transfer material gripping mechanism 610 includes a plurality of pairs of a transfer material gripping section 611 and a transfer material gripping section receptacle 612 that are discretely distributed along a roller axis direction and a plurality of transfer material exfoliation members 640 appropriately disposed along the roller axis direction between the pairs. All the transfer material gripping sections 611 are configured so as to be able to move so that the transfer material is gripped by pinching the material with the transfer material gripping section receptacle 612 or released by opening up the space with the transfer material gripping section receptacle 612. All the transfer material exfoliation members 640 are operated to extract the transfer material gripped between the transfer material gripping section 611 and the transfer material gripping section receptacle 612 and to press it away from the secondary transfer roller 61 side.

In both ends of the roller shaft 602 of the secondary transfer roller 61, two abutting members 650 are provided. These abutting members 650 are configured such that the grooved portion 605 is provided in the secondary transfer roller 61 as seen from the roller axis direction, and the abutting surface is provided to match with the opened area. By making the abutting surface abut the supporting member described more fully below, the location between the secondary transfer roller 61 and the belt driving roller 41 can be controlled.

Figures 3A, 3B:
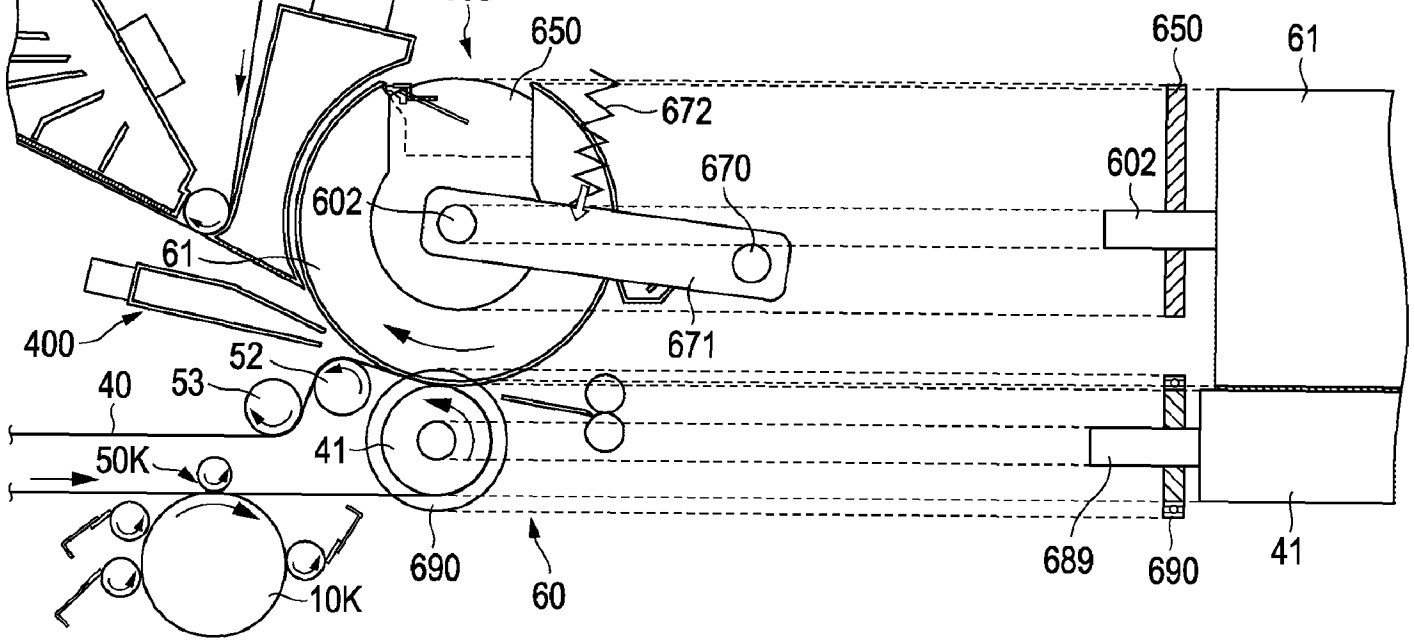
FIGS. 3A and 3B are diagrams for describing operations of a secondary transfer unit in an image forming apparatus according to an embodiment of the invention.
Figure 4B:
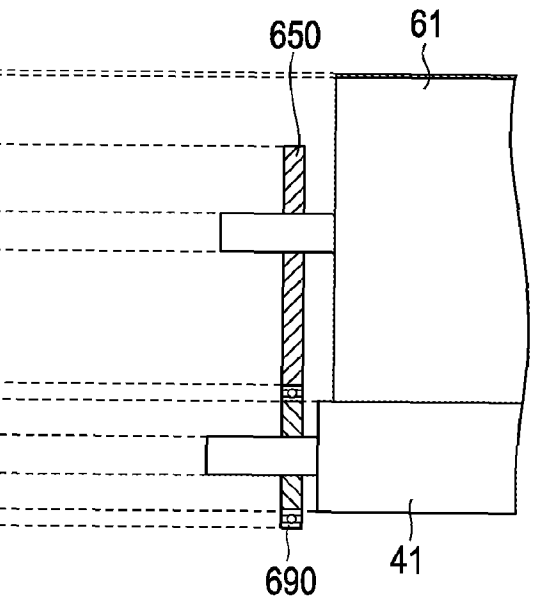
FIGS. 4A and 4B are diagrams for describing operations of a secondary transfer unit in an image forming apparatus according to an embodiment of the invention.
Figure 4A:
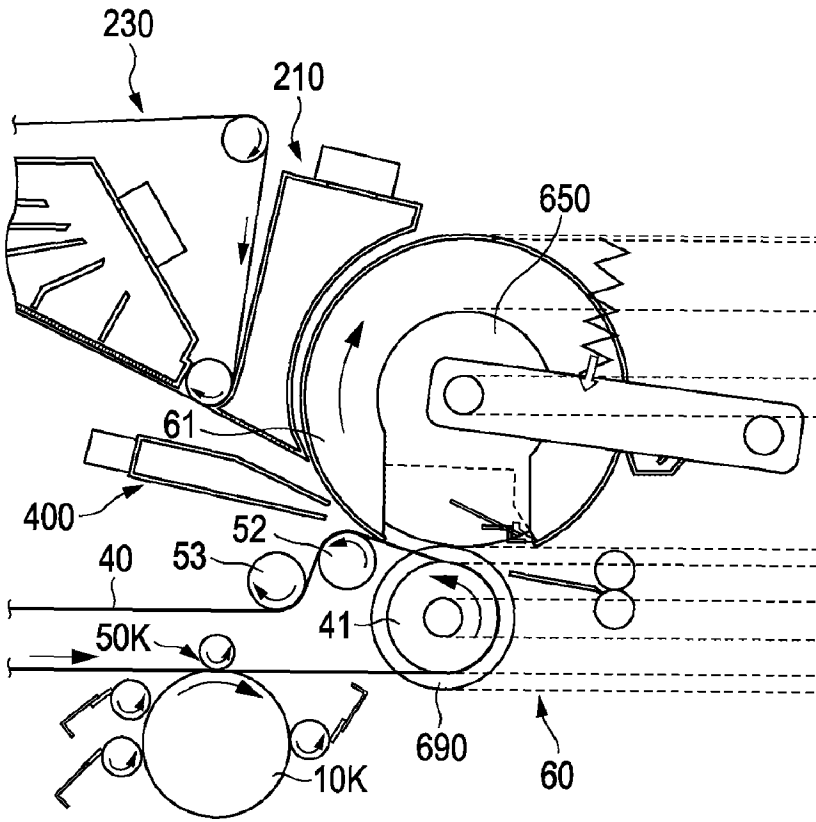

Next, the method for controlling the location between the secondary transfer roller 61 and the belt driving roller 41 will be described, such that a predetermined pressure may be applied to the secondary transfer nipping area in the secondary transfer section 60 including the secondary transfer roller 61 having a grooved portion 605 for storing the transfer material gripping mechanism 610. FIGS. 3A to 4B are diagrams for describing operations of the secondary transfer unit 60 in the image forming apparatus according to an embodiment of the invention. FIGS. 3A and 4A illustrate the secondary transfer unit 60 as seen from the lateral face of the image forming apparatus, whereas FIGS. 3B and 4B illustrate a schematic cross-section of the secondary transfer unit 60. Referring to FIGS. 3A to 4B, an abutting member 650, a pivot spindle 670, a frame member 671, a pressing member 672, a roller shaft 689 of the belt driving roller 41, and an supporting member 690 are provided.

In the secondary transfer unit 60, the roller shaft 602 of the secondary transfer roller 61 is installed in the frame member 671 so as to be able to pivot at both ends. The frame member 671 is able to pivot with respect to the pivot spindle 670 and is also pressed by the pressing member 672 in the direction shown by the arrow in FIG. 3A. In such a structure, the secondary transfer roller 61 is pressed toward the belt driving roller 41 so that a predetermined pressure can be applied to the secondary transfer nip between the secondary transfer roller 61 and the belt driving roller 41. By using the transfer bias and the transfer pressure provided by the secondary transfer nip, the toner particles on the transfer belt 40 are effectively transferred to the transfer material side at the secondary transfer nipping area.

At both ends of the roller shaft 602 of the secondary transfer roller 61, two abutting members 650 are provided. Two supporting members 690 corresponding to the abutting members 650 are also provided at both ends of the roller shaft 689 of the belt driving roller 41. As shown in the FIGS. 3B and 4B, the abutting members 650 and the supporting members 690 are disposed to match in an axial direction.

The abutting member 650 includes an abutting surface 663 having a distance $R_3$ from the rotation center O of the secondary transfer roller 61 as shown in FIG. 2. The abutting surface 663 is provided in an area corresponding to the opening area in the grooved portion 605 of the secondary transfer roller 61 as seen in a roller axis direction. As the image forming apparatus is operated, the abutting surface 663 abuts on the supporting member 690 in the belt driving roller 41 side when the grooved portion 605 faces the belt driving roller 41 or the transfer belt 40. Thereby, the supporting member 690 receives a pressing force from the secondary transfer roller 61 so that the distance and positional relationship between the secondary transfer roller 61 and the belt driving roller 41 can be maintained.

The abutting member 650 shown in FIG. 2 is provided in the shaft of the secondary transfer roller 61, and the distance from the rotation center of the secondary transfer roller 61 to the outer circumference varies so that it can function as a sort of a cam.

The supporting member 690 has an outer circumference having a constant distance from the rotation center O' of the belt driving roller 41 and may be a bearing or the like. As each roller is rotated, the supporting member 690 abuts on the abutting surface 663 of the abutting member 650 and receives the load from the secondary transfer roller 61 pressed by the pressing member 672 so that the distance and the positional relationship between the secondary transfer roller 61 and the belt driving roller 41 is maintained.

As each roller is rotated, the secondary transfer unit 60 is operated in sequence from the state shown in FIGS. 3A and 3B to the state shown in FIGS. 4A and 4B to the state shown in FIGS. 3A and 3B to the state shown in FIGS. 4A and 4B, and so forth. In FIGS. 3A and 3B, the grooved portion 605 does not face the belt driving roller 41 or transfer belt 40. In this state, the pressing force from the pressing member 672 is applied to the secondary transfer nip to obtain the predetermined transfer pressure, and an appropriate transfer bias is applied between the secondary transfer roller 61 and the belt driving roller 41 so that the toner particles on the transfer belt 40 are transferred to the transfer material side at the secondary transfer nipping area. In the state shown in FIGS. 3A and 3B, the abutting member 650 and the supporting member 690 are constantly separated from each other. A distance to the outer circumference except for the area corresponding to the grooved portion 605 in the abutting member 650 is set to consistently separate the abutting member 650 from the supporting member 690 so that the pressing force from the pressing member 672 can contribute to obtaining a predetermined transfer pressure in the transfer nipping area.

Figure 7B:
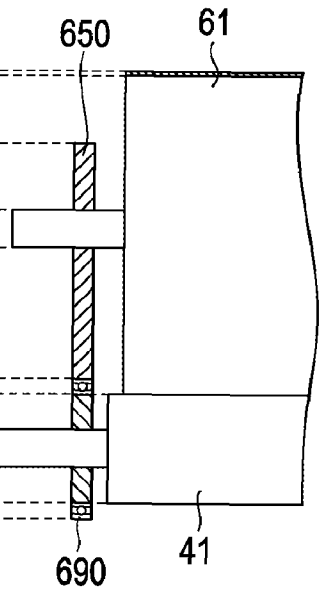
FIGS. 7A and 7B are diagrams for describing operations of a secondary transfer unit in an image forming apparatus according to another embodiment of the invention.
Figure 7A:
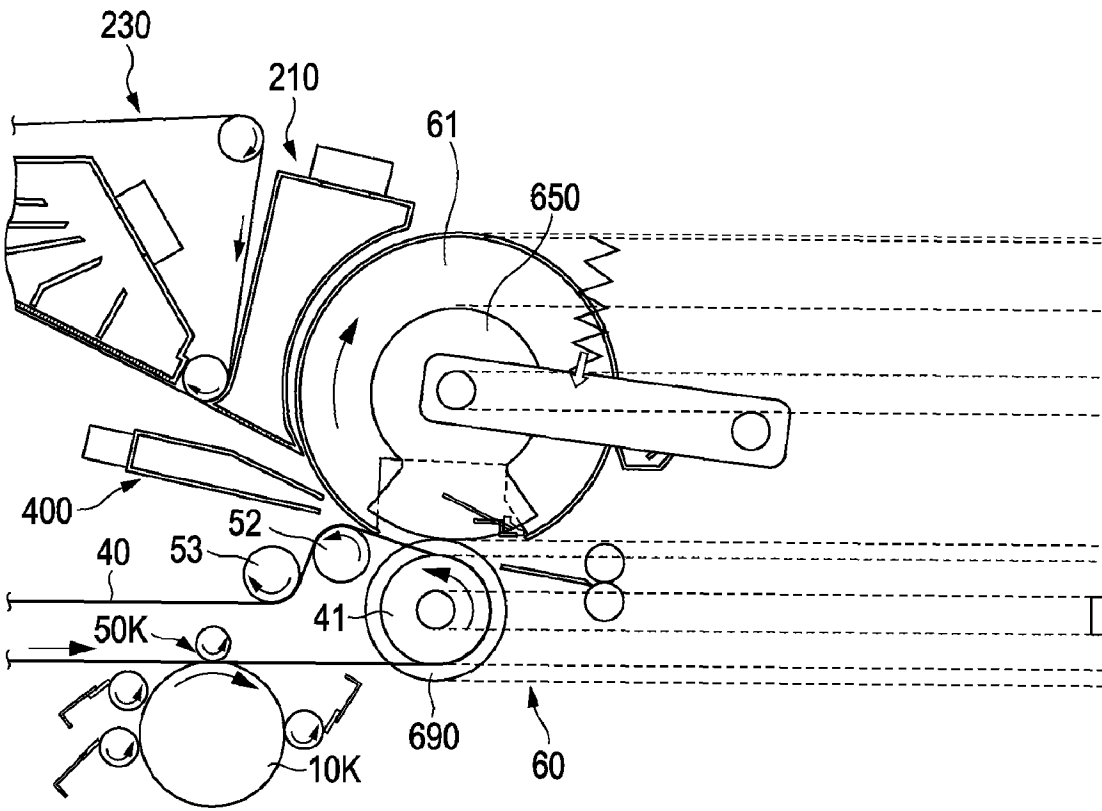

FIGS. 7A and 7B illustrate a state that the rotation of each roller further progresses. Referring to FIGS. 7A and 7B, the grooved portion 605 perfectly faces the belt driving roller 41 or the transfer belt 40, and the abutting surface 663 of the abutting member 650 abuts on the supporting member 690 while each roller is rotated. At this moment, the pressing force of the secondary transfer roller 61 pressed by the pressing member 672 is applied to the supporting member 690 so that the distance and the positional relationship between the secondary transfer roller 61 and the belt driving roller 41 are maintained.

According to the present embodiment, while the secondary transfer roller 61 is pressed to the belt driving roller 41 side, the shaft of the secondary transfer roller 61 has the abutting member 650, and the shaft of the belt driving roller 41 has the supporting member 690. As a result, the secondary transfer roller 61 can be used to apply a predetermined pressure to the transfer nipping area when the grooved portion 605 does not make contact with the transfer belt. Simultaneously, the positional relationship between the secondary transfer roller 61 and the belt driving roller 41 can be maintained when the grooved portion faces the transfer belt.

In print industries, a so-called bearer which is an abutting member having a concentric circle has been used to control an abutting position between rollers (e.g., see JP-A-2000-33686). When the transfer is performed in this way, the distance between rollers is controlled by positions of each bearer. As a result, there was a problem in that, if a transfer material such as paper has a different thickness, the transfer pressure is accordingly changed, and thereby, the transfer may become unstable. According to the present embodiment, however, even when the secondary transfer roller 61 having the grooved portion 605 is used, or even when the thickness of a transfer material differs, it is possible to maintain a constant transfer pressure.

Next, a configuration will be described in detail which is used for controlling the location between the secondary transfer roller 61 and the belt driving roller 41 by applying a predetermined pressure to the secondary transfer nip in the secondary transfer section 60 including the secondary transfer roller 61 having a grooved portion 605 for storing the transfer material gripping mechanism 610. FIGS. 5A to 8B are diagrams for describing operations of the secondary transfer unit 60 in the image forming apparatus according to an embodiment of the invention. FIGS. 5A, 6A, 7A, and 8A illustrate the secondary transfer unit 60 as seen from the lateral face of the image forming apparatus, whereas FIGS. 5B, 6B, 7B, and 8B illustrate a schematic cross-section of the secondary transfer unit 60. Referring to FIGS. 5A to 8B, an abutting member 650, a pivot spindle 670, a frame member 671, a pressing member 672, a roller shaft 689 of the belt driving roller 41, and an supporting member 690 are provided. FIG. 9 illustrates a configuration associated with the secondary transfer roller 61 and the belt driving roller 41 and a relationship between the abutting member 650 and the supporting member 690. In FIG. 9, a first passing surface 661 of the abutting member 650, an abutting surface 663, and a second passing surface 662 are provided.

In the secondary transfer unit 60, the roller shaft 602 of the secondary transfer roller 61 is installed in the frame member 671 so as to be able to pivot at both ends. The frame member 671 is able to pivot with respect to the pivot spindle 670 and is also pressed by the pressing member 672 toward the direction of the arrow shown in FIG. 5A. In such a structure, the secondary transfer roller 61 is pressed toward the belt driving roller 41 so that a predetermined pressure can be applied to the secondary transfer nipping area between the secondary transfer roller 61 and the belt driving roller 41. By using the transfer bias and the transfer pressure provided by the secondary transfer nip, the toner particles on the transfer belt 40 are effectively transferred to the transfer material side at the secondary transfer nip.

At both ends of the roller shaft 602 of the secondary transfer roller 61, two abutting members 650 are provided. Two supporting members 690 corresponding to the abutting members 650 are also provided at both ends of the roller shaft 689 of the belt driving roller 41. As shown in FIGS. 5B, 6B, 7B and 8B, the abutting members 650 and the supporting members 690 are disposed to match in an axial direction.

The abutting member 650 includes an abutting surface 663 having a distance $R_3$ from the rotation center O of the secondary transfer roller 61, and first and second passing surfaces 661 and 662 disposed in both ends of the abutting surface 663 as shown in FIG. 9. The abutting surface 663 is provided in an area corresponding to the opening area (i.e., the abutting area $C_3$) in the grooved portion 605 of the secondary transfer roller 61 as seen in a roller axis direction. As the image forming apparatus is operated, the abutting surface 663 or abutting area $C_3$ abuts the supporting member 690 in the belt driving roller 41 side when the grooved portion 605 faces the belt driving roller 41 or the transfer belt 40. Thereby, the supporting member 690 receives a pressing force from the secondary transfer roller 61 so that the distance and positional relationship between the secondary transfer roller 61 and the belt driving roller 41 can be maintained.

As the secondary transfer roller 61 and the belt driving roller 41 are rotated, there is a repeated alternation between the constant load state in which a constant pressure is applied to the secondary transfer nip and the fixed position state in which the secondary transfer roller 61 and the belt driving roller 41 are located in a fixed positional relationship. However, transition between each state can be seamlessly made without generating vibration by using the first and second passing surfaces 661 and 662 or areas $C_1$ and $C_2$ provided in both sides of the abutting surface 663 and the curved surfaces provided in the opening edges 613 and 613'. As a result, it is possible to suppress influences on the image forming process and prevent image quality degradation. While the first and second passing surfaces 661 and 662 or areas $C_1$ and $C_2$ are tapered in the present embodiment, they may be curved with a predetermined curvature.

The abutting member 650 shown in FIG. 9 is provided in the shaft of the secondary transfer roller 61, and a distance from the rotation center of the secondary transfer roller 61 to the outer circumference varies (e.g., distances are different from the rotation center to the abutting area $C_3$, the area $C_1$ or $C_2$, or other areas) so that it can function as a sort of a cam.

The supporting member 690 has an outer circumference having a constant distance from the rotation center O' of the belt driving roller 41 and may be a bearing or the like. As each roller is rotated, the supporting member 690 abuts on the abutting surface 663 of the abutting member 650 and receives the load from the secondary transfer roller 61 pressed by the pressing member 672 so that the distance and positional relationship between the secondary transfer roller 61 and the belt driving roller 41 are maintained.

Figures 5A, 5B:
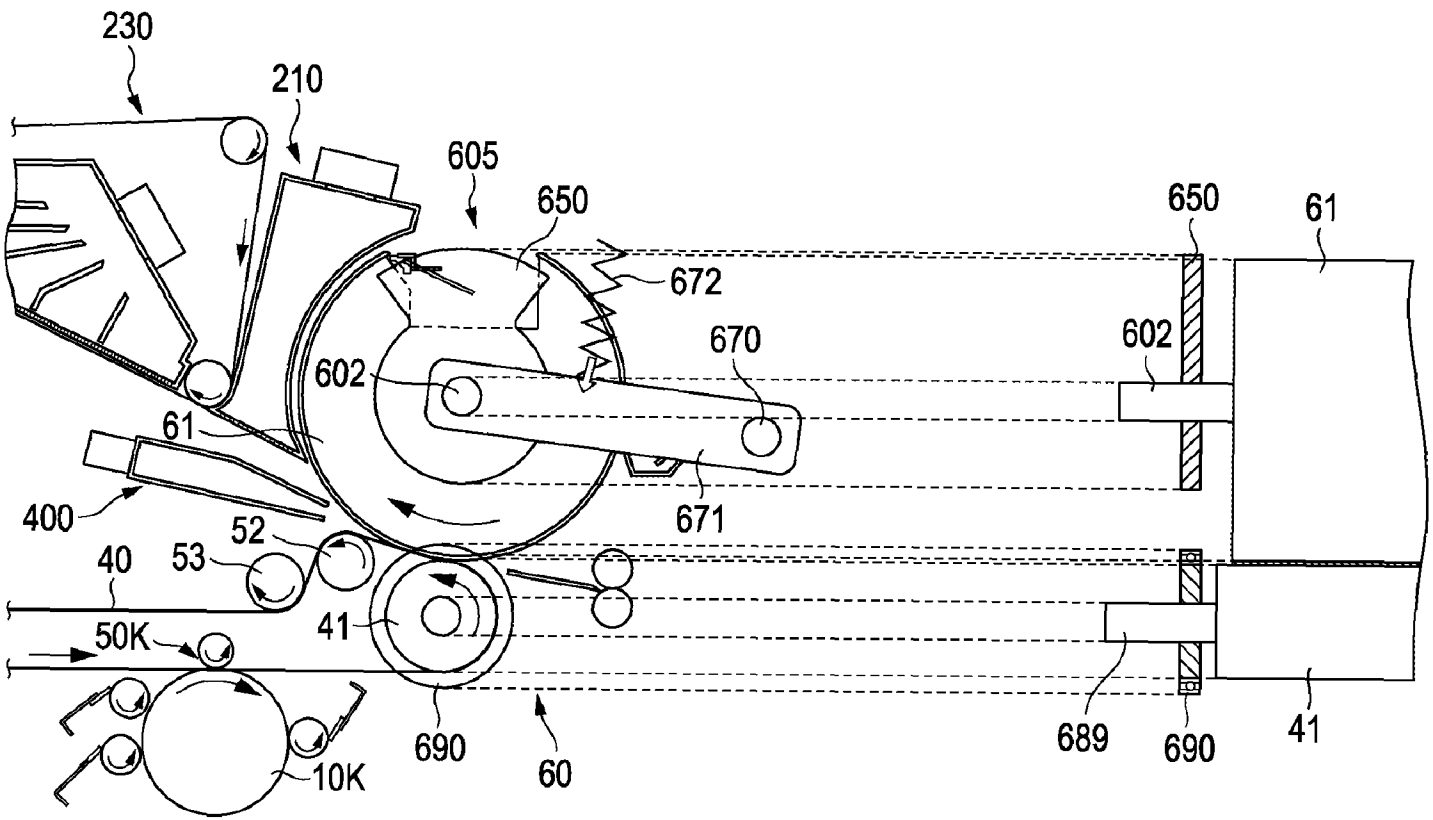
FIGS. 5A and 5B are diagrams for describing operations of a secondary transfer unit in an image forming apparatus according to another embodiment of the invention.
Figures 6A, 6B:
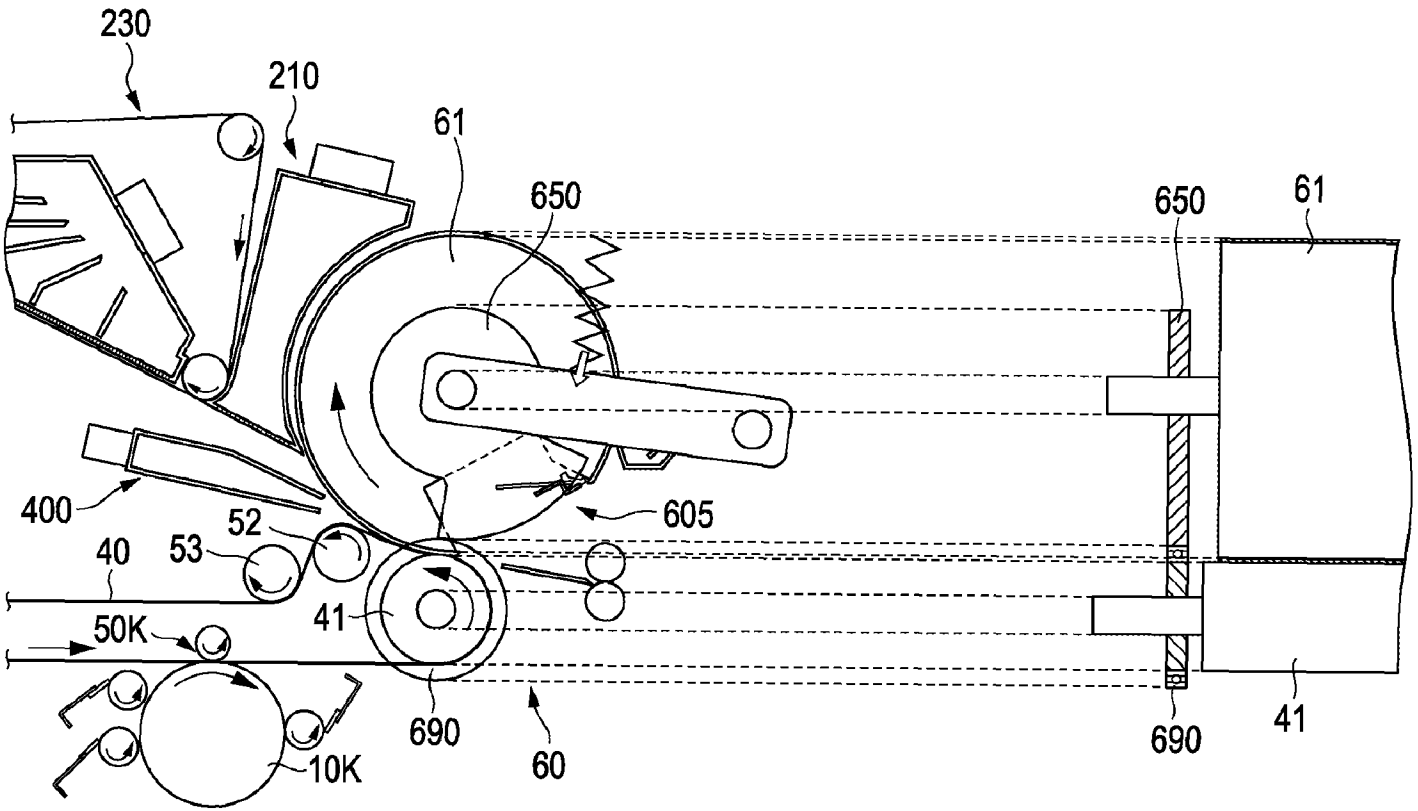
FIGS. 6A and 6B are diagrams for describing operations of a secondary transfer unit in an image forming apparatus according to another embodiment of the invention.
Figures 8A, 8B:
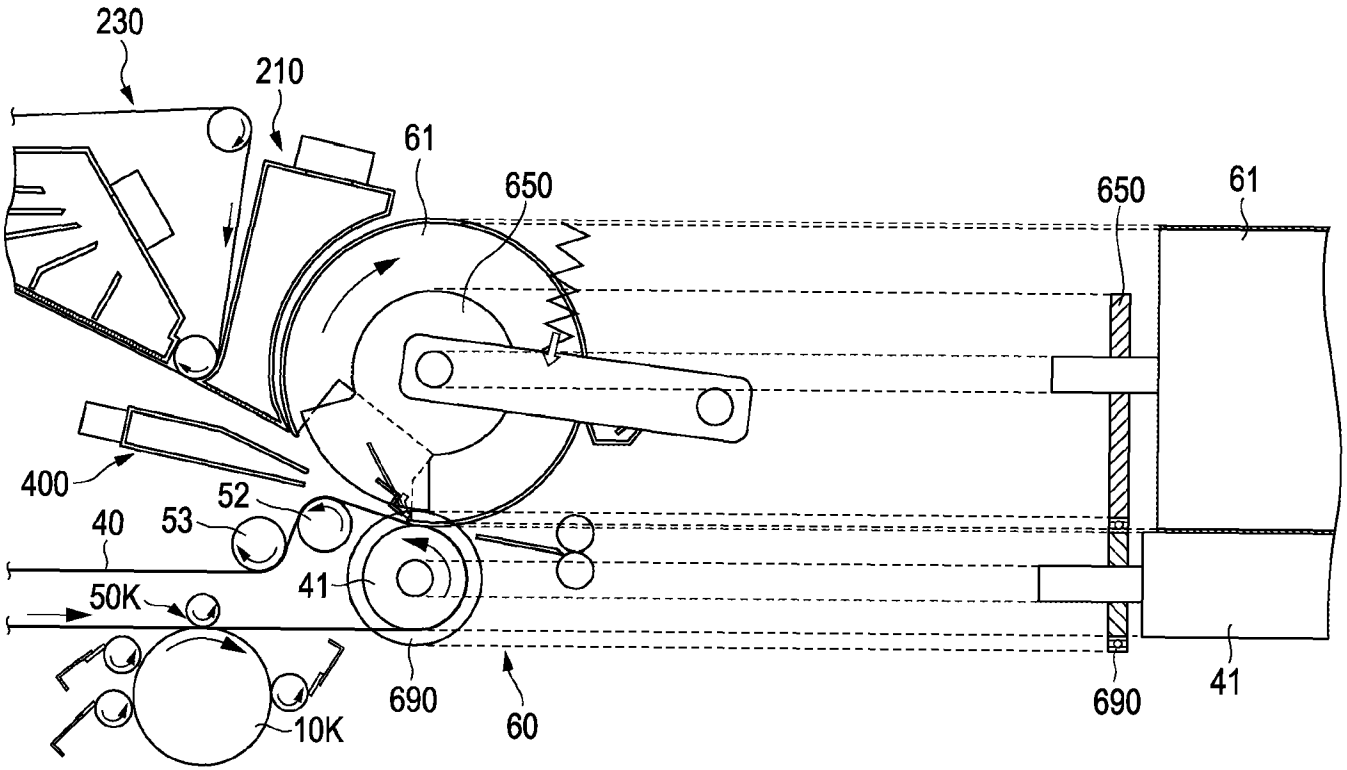
FIGS. 8A and 8B are diagrams for describing operations of a secondary transfer unit in an image forming apparatus according to another embodiment of the invention.
Figure 9:
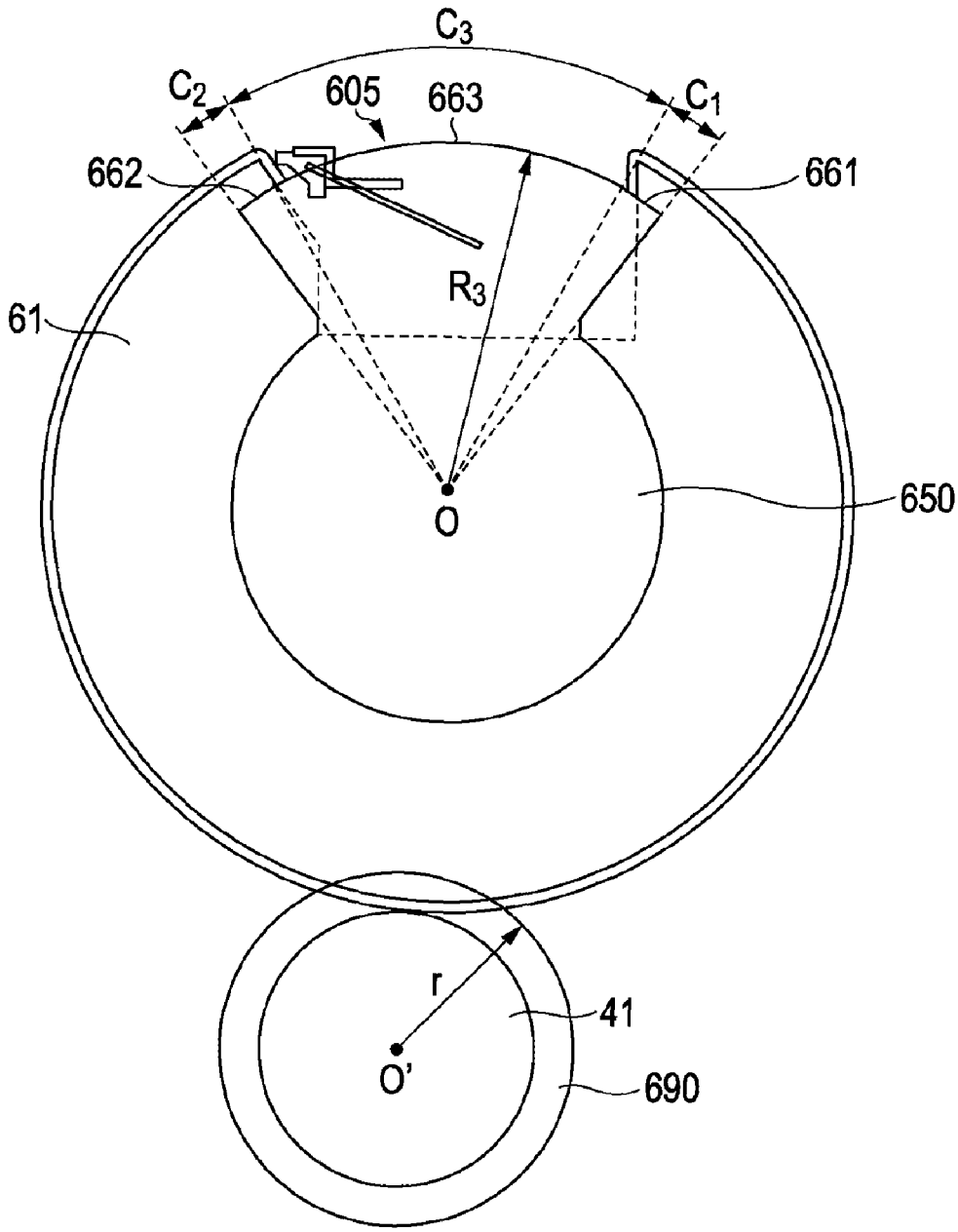
FIG. 9 is a diagram for describing a relationship between an abutting member and an supporting member.

As each roller is rotated, the secondary transfer unit 60 is operated in sequence from the state shown in FIGS. 5A and 5B to the state shown in FIGS. 6A and 6B to the state shown in FIGS. 7A and 7B to the state shown in FIGS. 8A and 8B to the state shown in FIGS. 5A and 5B and so forth. In FIGS. 5A and 5B, the grooved portion 605 does not face the belt driving roller 41 or the transfer belt 40. In this state, the pressing force from the pressing member 672 is applied to the secondary transfer nip to obtain a predetermined transfer pressure, and an appropriate transfer bias is applied between the secondary transfer roller 61 and the belt driving roller 41 so that the toner particles on the transfer belt 40 are transferred to the transfer material side at the secondary transfer nip. In the state shown in FIGS. 5A and 5B, the abutting member 650 and the supporting member 690 are consistently separated from each other.

FIGS. 6A and 6B illustrate the state just before the grooved portion 605 reaches the belt driving roller 41 or the transfer belt 40 as the rotation of each roller progresses. At this moment, as each roller is rotated, the first passing surface 661 or area $C_1$ of the abutting member 650 is slowly moved closer to the supporting member 690. In other words, a distance between the first passing surface 661 or area $C_1$ and the supporting member 690 is slowly shortened. As the rotation further progresses, the abutting member 650 abuts on the supporting member 690 at the border between the first passing surface 661 or area $C_1$ and the abutting surface 663 or area $C_3$, and the load from the secondary transfer roller 61 is applied to the supporting member 690 so that the distance and the positional relationship between the secondary transfer roller 61 and the belt driving roller 41 are maintained. At the moment the abutting member 650 abuts on the supporting member 690, the grooved portion 605 faces the belt driving roller 41 or the transfer belt 40.

FIGS. 7A and 7B illustrate the state of rotation of each roller as the rotation further progresses. Referring to FIGS. 7A and 7B, the grooved portion 605 perfectly faces the belt driving roller 41 or the transfer belt 40, and the abutting surface 663 or abutting area $C_3$ of the abutting member 650 abuts on the supporting member 690 while each roller is rotated. At this moment, the pressing force of the secondary transfer roller 61 pressed by the pressing member 672 is applied to the supporting member 690 so that the distance and positional relationship between the secondary transfer roller 61 and the belt driving roller 41 is maintained.

As the rotation of each roller further progresses, at the border between the abutting surface 663 or abutting area $C_3$ of the abutting member 650 and the second passing surface 662 or area $C_2$, the abutting member 650 is separated from the supporting member 690, and further, the second passing surface 662 or area $C_2$ of the abutting member 650 slowly recedes from the supporting member 690. FIGS. 8A and 8B illustrate this state. At this moment, as the grooved portion 605 recedes from the belt driving roller 41 or the transfer belt 40, the elastic member 607 of the secondary transfer roller 61 makes contact with the transfer belt 40, and a pressing force from the pressing member 672 is applied to the secondary transfer nip. Furthermore, the abutting member 650 is separated from the supporting member 690, and the load from the abutting member 650 is released from the supporting member 690.

According to the present embodiment, while the secondary transfer roller 61 is pressed to the belt driving roller 41 side, the shaft of the secondary transfer roller 61 has the abutting member 650, and the shaft of the belt driving roller 41 has the supporting member 690. As a result, the secondary transfer roller 61 can be used to apply a predetermined pressure to the transfer nipping area when the grooved portion 605 does not make contact with the transfer belt. Simultaneously, the positional relationship between the secondary transfer roller 61 and the belt driving roller 41 can be maintained when the grooved portion faces the transfer belt.

According to the present embodiment, even when the secondary transfer roller 61 having the grooved portion 605 is used, transition can be seamlessly made without generating vibration between the constant load state in which a constant pressure is applied to the secondary transfer nipping and the fixed relationship between the secondary transfer roller 61 and the belt driving roller 41 can be maintained. As a result, it is possible to suppress influences on the image forming process and prevent image quality degradation.

Figure 10:
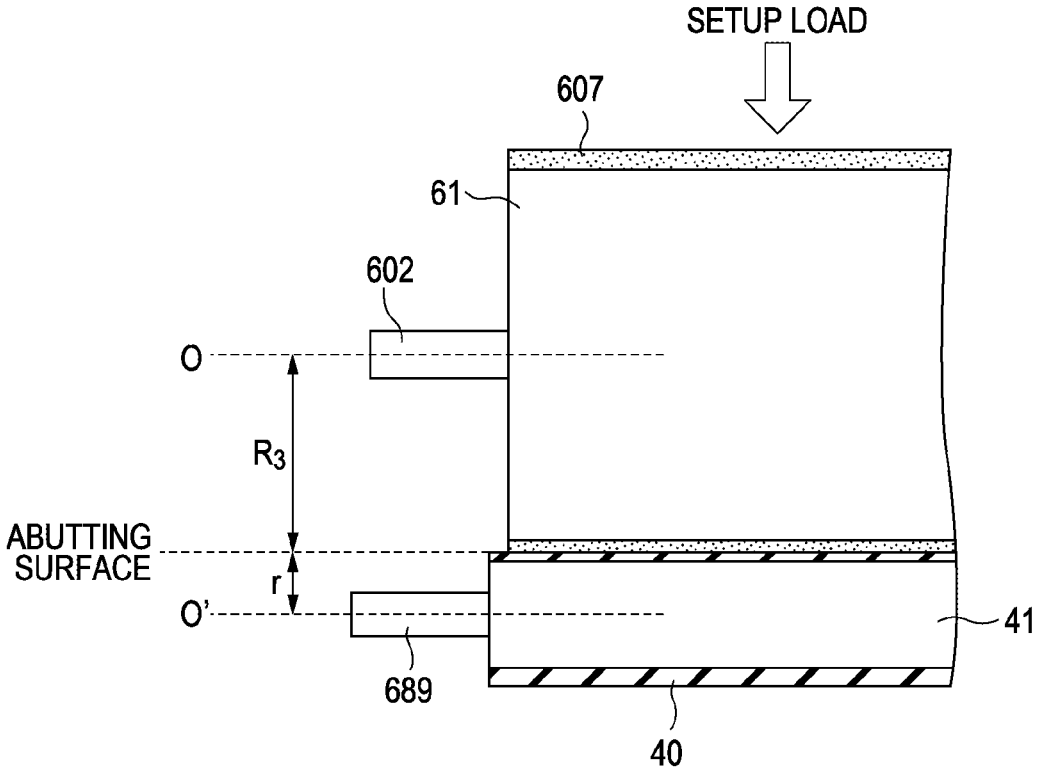
FIG. 10 is a schematic diagram exaggeratedly illustrating a secondary transfer roller, a belt driving roller, and a transfer belt.

Next, a method of determining the distance $R_3$ in the abutting member 650 will be described. FIG. 10 is a schematic diagram exaggeratedly illustrating the secondary transfer roller 61, the belt driving roller 41, the transfer belt 40, or the like. In FIG. 10, the transfer belt 40 and the elastic member 607 disposed in the secondary transfer roller 61 are contracted by the transfer pressure at the secondary transfer nip portion with a setup load being applied from the pressing member 672. In FIG. 2, the transfer material is not inserted into the secondary transfer nip portion. The image forming apparatus according to the present embodiment determines the distance $R_3$ of the abutting member 650 by obtaining a distance between the rotation center O of the secondary transfer roller 61 and the abutting surface of the nip portion in the state shown in FIG. 10. In addition, the image forming apparatus also determines the distance r of the supporting member 690 by obtaining a distance between the rotation center O' of the belt transfer roller 41 and the abutting surface of the nip portion.

The aforementioned method of determining the distance $R_3$ of the abutting member 650 is characterized in that the distance $R_3$ is determined by setting a state that the transfer material is not provided as a reference. Generally, the image forming apparatus dealing with color images executes a so-called register adjustment to adjust positions for overlapping four colors. However, in this adjustment, the toner images formed on the transfer belt 40 are read using a sensor, and differences between each color are recognized to adjust exposure timings of the exposure units 12Y, 12M, 12C, and 12K or the like. Since the distance $R_3$ of the abutting member 650 is not determined by the transfer material, it is possible to improve accuracy in the register adjustment.

If the distance R3 of the abutting member 650 is determined as described above, it is possible to suppress generation of vibration when the state shown in FIGS. 6A and 6B is changed to the state shown in FIGS. 7A and 7B because the abutting member 650 makes contact with the supporting member 690 in the state shown in FIG. 10 when the state shown in FIGS. 6A and 6B is changed to the state shown in FIGS. 7A and 7B.

Figure 11:
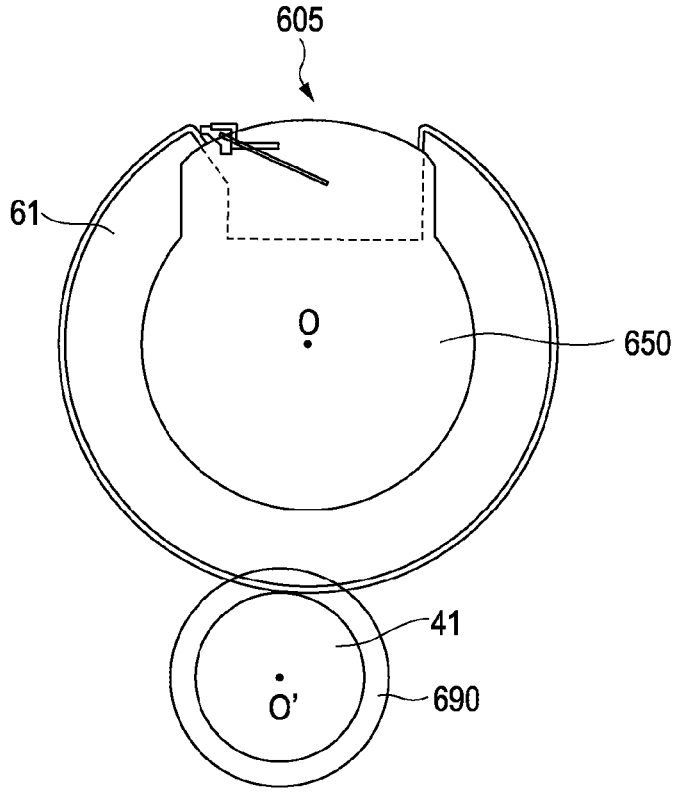
FIG. 11 is a diagram for describing an abutting member and an supporting member in an image forming apparatus according to another embodiment of the invention.

Another embodiment of the invention will now be described. FIG. 11 is a diagram for describing the abutting member 650 and the supporting member 690 in the image forming apparatus according to another embodiment of the invention. FIG. 11 specifically illustrates a configuration related to the secondary transfer roller 61 and the belt driving roller 41. In the aforementioned embodiments shown in FIG. 9, the upper half of the abutting member 650 has an approximately fan shape, and the abutting surface 663 or abutting area $C_3$ or first or second passing surface 661 or 662 or area $C_1$ or $C_2$ is formed in edge portions of this fan shape. However, according to the present embodiment, as shown in FIG. 11, the upper half of the abutting member 650 has an approximately rectangular shape, and the abutting surface 663 or the first or second passing surface 661 or 662 or area $C_2$ is formed in edge portions of this rectangular shape. By using such an abutting member 650, it is possible to achieve similar effects to those of the aforementioned embodiments. Additionally, it is possible to suppress variations of the roller center caused by the abutting member 650 because the shape of the abutting member 650 corresponding to a single cycle is not significantly changed.

Figure 12:
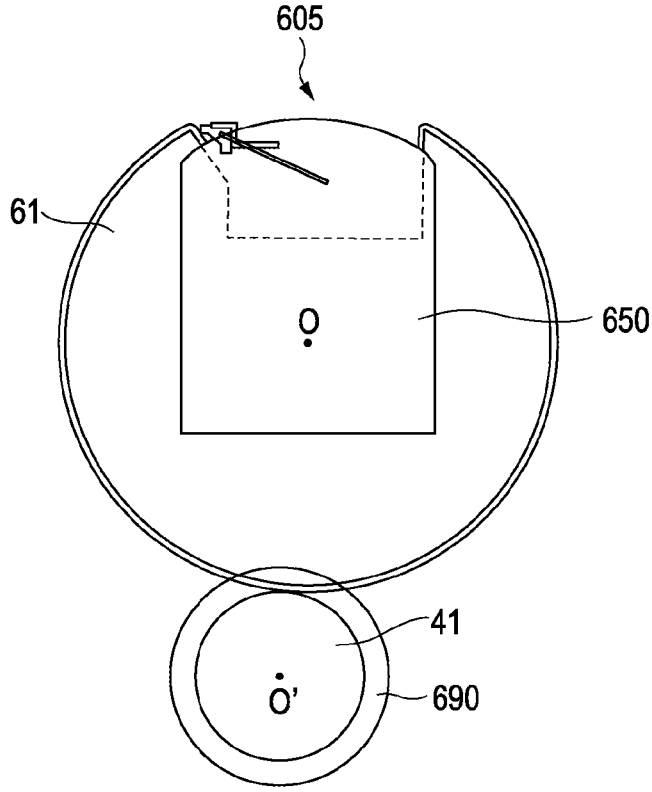
FIG. 12 is a diagram for describing an abutting member and an supporting member in an image forming apparatus according to another embodiment of the invention.

Another embodiment of the invention will now be described. FIG. 12 is a diagram for describing the abutting member 650 and the supporting member 690 in the image forming apparatus according to another embodiment of the invention. FIG. 12 particularly illustrates a configuration related to the secondary transfer roller 61 and the belt driving roller 41. In the embodiment shown in FIG. 12, the abutting member 650 has a rectangular shape, and the abutting member 663 or the first or second passing surface 661 or 662 or area $C_2$ is formed in the edges of one side of the rectangular shape. By using such an abutting member 650, it is possible to achieve similar effects to those of the aforementioned embodiments. Additionally, it is possible to reduce the cost of manufacturing the abutting member 650 because the abutting member 650 is fabricated in a simpler way.

Figure 13:
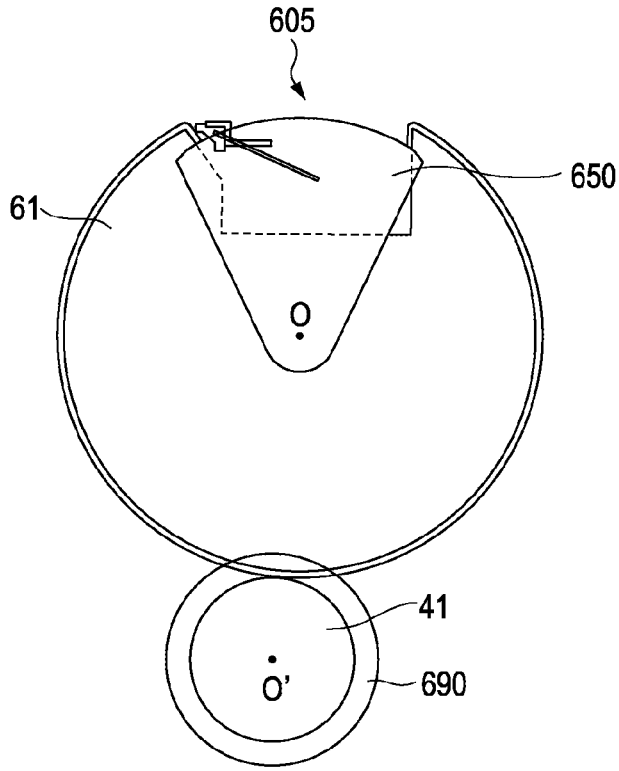
FIG. 13 a diagram for describing an abutting member and an supporting member in an image forming apparatus according to another embodiment of the invention.

Another embodiment of the invention will now be described. FIG. 13 is a diagram for describing the abutting member 650 and the supporting member 690 in the image forming apparatus according to another embodiment of the invention. FIG. 13 specifically illustrates a configuration related to the secondary transfer roller 61 and the belt driving roller 41. In the embodiment shown in FIG. 13, the abutting member 650 has a fan shape, and the abutting surface 663 or the first or second passing surface 661 or 662 or area $C_2$ is formed in the edges of one side of the fan shape. By using such an abutting member 650, it is possible to achieve similar effects to those of the aforementioned embodiments. Additionally, it is possible to achieve an additional effect, because in the second transfer roller 61, the portion where the grooved portion 605 is provided may have a lighter weight, and this may adversely affect weight balance. However, the abutting member 650 according to the present embodiment can stabilize weight balance of the entire secondary transfer roller 61.

Figure 14:
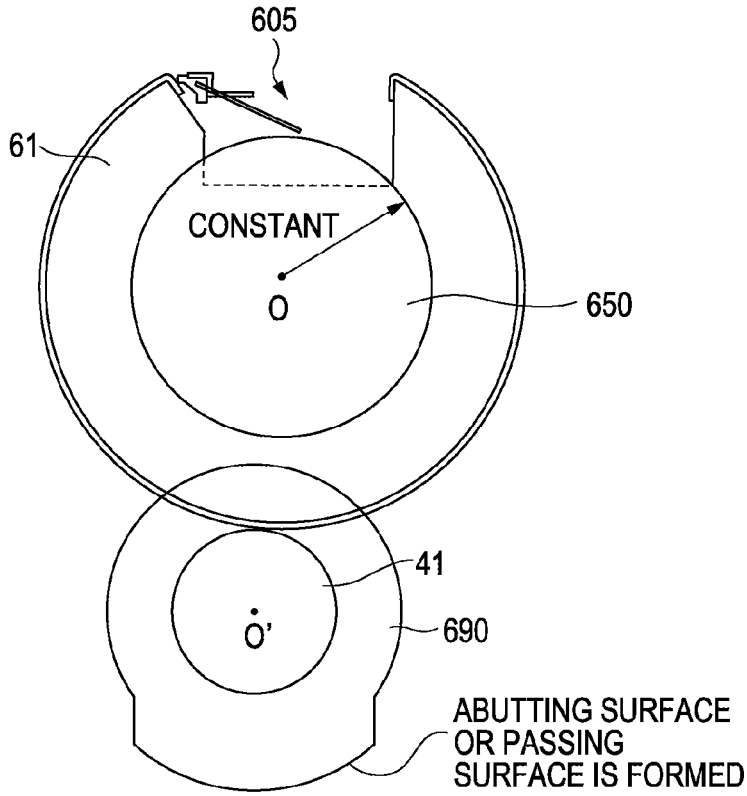
FIG. 14 is a diagram for describing an abutting member and an supporting member in an image forming apparatus according to another embodiment of the invention.

Another embodiment of the invention will now be described. FIG. 14 is a diagram for describing the abutting member 650 and the supporting member 690 in the image forming apparatus according to another embodiment of the invention. FIG. 14 particularly illustrates a configuration related to the secondary transfer roller 61 and the belt driving roller 41. In the embodiment shown in FIG. 14, a member such as a bearing having an outer circumference with a constant distance from the center O of the roller rotation is used as the abutting member 650. On the contrary, a member having the abutting surface or the first or second passing surface is used in the supporting member 690. Even when such an abutting member 650 and such an supporting member 690 are used, it is possible to achieve similar effects to those of the aforementioned embodiments.

Additionally, the embodiment shown in FIG. 14 can be applied when a diameter of the belt driving roller 41 which faces the secondary transfer roller 61 is an integral multiple of a diameter of the secondary transfer roller 61.

Figure 15:
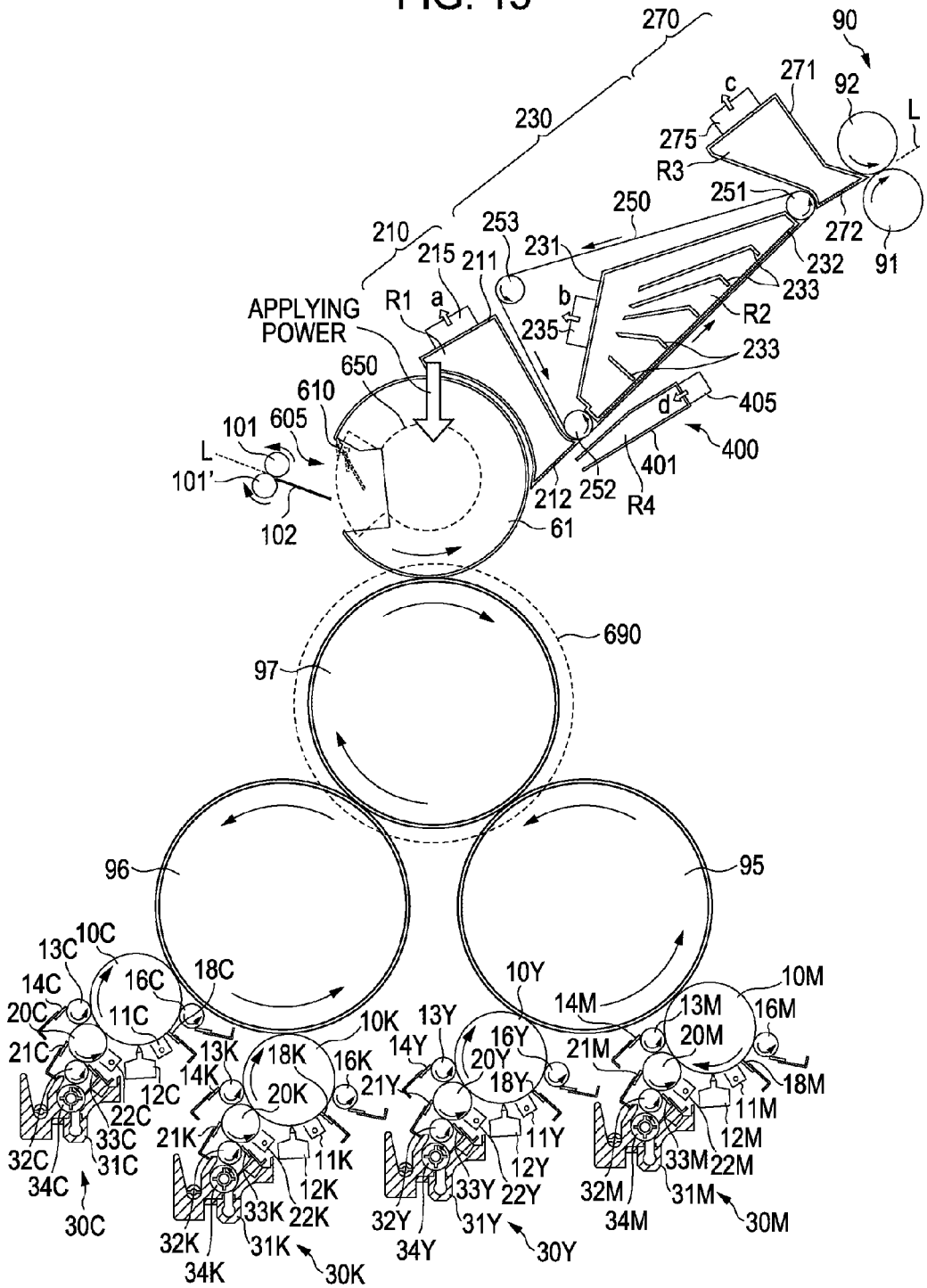
FIG. 15 illustrates main components of an image forming apparatus according to another embodiment of the invention.

Another embodiment of the invention will now be described. FIG. 15 illustrates main components of the image forming apparatus according to another embodiment of the invention. Like reference numerals denote like elements throughout various embodiments, and descriptions thereof will be omitted. The present embodiment is different from the aforementioned embodiments in that first, second, and third transfer rollers 95, 96, and 97 are used instead of the transfer belt 40.

On the first transfer roller 95, yellow Y and magenta M toner images are formed by the developing devices 30Y and 30M. On the second transfer roller 96, cyan C and black K toner images are formed by the developing devices 30C and 30K. The yellow Y and magenta M toner images on the first transfer roller 95 and the cyan C and black K toner images on the second transfer roller 96 are subsequently transferred to the third transfer roller 97. The second transfer roller 61 is pressed to the third transfer roller 97 by a mechanism (not shown) to apply a predetermined pressure to each nip portion during the transfer.

By passing the transfer material gripped in the transfer material gripping mechanism 610 through a nipping area between the third transfer roller 97 and the secondary transfer roller 61, a full-color toner image is formed.

Similar to the aforementioned embodiments, two abutting members 650 are provided in the shaft of the secondary transfer roller 61, and the supporting member 690 is provided in the shaft of the third transfer roller 97. Similar to the aforementioned embodiments, the first or second passing surface is formed in the abutting member 65.

While the secondary transfer roller 61 is pressed to the third transfer roller 97 side, the shaft of the secondary transfer roller 61 has the abutting member 650, and the shaft of the third transfer roller 97 has the first and second supporting members 690. As a result, the secondary transfer roller 61 can be used to apply a predetermined pressure to the transfer nip when the grooved portion 605 does not make contact with the transfer roller. Additionally, the positional relationship between the secondary transfer roller 61 and the transfer roller can be maintained when the grooved portion 605 faces the transfer roller.

According to the image forming apparatus and the image forming method of the invention, even when the secondary transfer roller 61 having the grooved portion 605 is used, transition can be seamlessly made without generating vibration between the constant load state in which a constant pressure is applied to the transfer nip and the fixed position state in which the secondary transfer roller 61 and the third transfer roller 97 are maintained in a fixed positional relationship. As a result, it is possible to suppress influences on the image forming process and prevent image quality degradation.

While various embodiments have been described herein, it should be noted that other embodiments that can be made without departing from the scope of the invention.

What is claimed is:

1. An image forming apparatus comprising:

an image carrier that carries an image;

a transfer roller that presses to the image carrier and has a grooved portion in an axial direction;

an abutting member that is arranged in an axial end side of the transfer roller and includes a first circumference portion having a first distance from a rotation center of the transfer roller and a second circumference portion having a second distance from the rotation center of the transfer roller which is shorter than the first distance; and a support member that abuts the abutting member, wherein the image carrier is an image bearing belt, wherein the image forming apparatus further comprises a belt winding roller around which the image bearing belt is looped, the belt winding roller abutting the transfer roller and pinching the image bearing belt there between, and wherein the support member is arranged on an axial end side of the belt winding roller.

2. The image forming apparatus according to claim 1, wherein the transfer roller has an elastic member which is pressed to the image carrier, and wherein the first circumferential end portion of the abutting member is arranged in an axial direction of the grooved portion of the transfer roller.

3. The image forming apparatus according to claim 1, wherein the support member has a constant distance from the rotation center of the belt winding roller to a circumference portion.

4. The image forming apparatus according to claim 1, wherein the abutting member is arranged at the other axial end side of the transfer roller, and the support member is arranged at the other axial end side of the belt winding roller.

5. The image forming apparatus according to claim 1, wherein the image carrier is an image bearing drum, and wherein the support member is arranged at an axial end side of the image bearing drum.

6. An image forming apparatus comprising:

an image carrier that moves into a first direction and carries an image;

a transfer roller that presses to the image carrier and has a grooved portion in an axial direction;

an abutting member that is arranged in a second direction perpendicular to the first direction of the image carrier and has a first circumference portion arranged at a first distance from the rotation center of the transfer roller when the first circumference portion faces the transfer roller and a second circumference portion disposed at a second distance different from the first distance from the rotation center of the transfer roller; and a support member that abuts on the abutting member, wherein the image carrier is an image bearing belt, wherein the image forming apparatus further comprises a belt winding roller around which the image bearing belt is looped, the belt winding roller abutting the transfer roller and pinching the image bearing belt there between, and wherein the support member is arranged on an axial end side of the belt winding roller.

7. An image forming method comprising:

storing an image on an image carrier;

transferring the image to a transfer material by passing the transfer material through a transfer nipping area formed by a transfer roller having a grooved portion in an axial direction abutting the image carrier;

making a first circumference portion of an abutting member arranged in an axial end side of the transfer roller abut on a support member which abuts the abutting member when the grooved portion of the transfer roller passes through the transfer nipping area after the transfer material passes through the transfer nipping area, the first circumference portion having a first distance from a rotation center of the transfer roller; and controlling positions of the image carrier and the transfer roller, wherein the image carrier is an image bearing belt, wherein an image forming apparatus including the image carrier further comprises a belt winding roller around which the image bearing belt is looped, the belt winding roller abutting the transfer roller and pinching the image bearing belt there between, and wherein the support member is arranged on an axial end side of the belt winding roller.

* * * * *